US009879576B2

(12) United States Patent
Hofmann

(10) Patent No.: US 9,879,576 B2
(45) Date of Patent: Jan. 30, 2018

(54) ADJUSTABLE CAMSHAFT

(71) Applicant: ThyssenKrupp Presta TecCenter AG, Eschen (LI)

(72) Inventor: Peter Hofmann, Rankweil (AT)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 31 days.

(21) Appl. No.: 15/035,566

(22) PCT Filed: Nov. 11, 2014

(86) PCT No.: PCT/EP2014/003008
§ 371 (c)(1),
(2) Date: May 10, 2016

(87) PCT Pub. No.: WO2015/070971
PCT Pub. Date: May 21, 2015

(65) Prior Publication Data

US 2016/0290185 A1 Oct. 6, 2016

(30) Foreign Application Priority Data

Nov. 14, 2013 (DE) ..... 10 2013 112 539

(51) Int. Cl.
*F01L 1/047* (2006.01)
*F01L 13/00* (2006.01)
*F01L 1/344* (2006.01)

(52) U.S. Cl.
CPC ..... *F01L 13/0036* (2013.01); *F01L 1/34413* (2013.01); *F01L 13/0042* (2013.01);
(Continued)

(58) Field of Classification Search
CPC ..... F01L 2001/0473; F01L 1/34413; F01L 13/0042; F01L 2013/0052; F01L 2103/02
(Continued)

(56) References Cited

U.S. PATENT DOCUMENTS 5,645,022 A * 7/1997 Yamamoto ..... F01L 1/0532 123/198 F
2010/0269769 A1* 10/2010 Schoeneberg ..... F01L 1/047 123/90.6

(Continued)

FOREIGN PATENT DOCUMENTS

DE 102007027979 A1 * 1/2009 ..... F01L 1/053
DE 102009039733 A1 3/2011

(Continued)

OTHER PUBLICATIONS

International Search Report for PCT/EP2014/003008 dated Jan. 27, 2015 (dated Feb. 5, 2015).

(Continued)

*Primary Examiner* — Jorge Leon, Jr.
(74) *Attorney, Agent, or Firm* — thyssenkrupp North America, Inc.

(57) ABSTRACT

An adjustable camshaft for an internal combustion engine may have a support shaft that extends along a rotational axis; a cam pack having a cam element that is received on the support shaft such that the cam pack can be displaced along the rotational axis, wherein the cam pack can be latched on the support shaft in at least two axial latching positions; a latching element that is prestressed by way of a spring element; and a latching element receptacle disposed on the support shaft. The latching element can latch into the latching element receptacle in the latching positions. The spring element and the latching element may be received in the cam pack.

7 Claims, 2 Drawing Sheets

(52) U.S. Cl.
CPC ..... *F01L 2001/0473* (2013.01); *F01L 2013/0052* (2013.01); *F01L 2103/02* (2013.01)

(58) Field of Classification Search
USPC ..... 123/90.18
See application file for complete search history.

(56) References Cited

U.S. PATENT DOCUMENTS

| | | | | |
|---|---|---|---|---|
| 2010/0288217 | A1* | 11/2010 | Stolk ..... | F01L 1/047 123/90.17 |
| 2012/0204824 | A1* | 8/2012 | Kamichika ..... | F01L 1/047 123/90.15 |
| 2013/0047944 | A1* | 2/2013 | Schwarzenthal ..... | F01L 1/047 123/90.18 |

FOREIGN PATENT DOCUMENTS

| | | | | |
|---|---|---|---|---|
| DE | WO 2011026562 | A1 * | 3/2011 | ..... F01L 1/047 |
| DE | 102010011897 | A1 | 9/2011 | |
| DE | 102011003024 | A | 7/2012 | |
| DE | 102011085706 | A1 * | 5/2013 | ..... F01L 1/047 |
| DE | 102011117244 | A | 5/2013 | |
| GB | 112583 | A | 1/1918 | |
| JP | 2013060858 | A * | 4/2013 | |

OTHER PUBLICATIONS

English Language Abstract for DE102010011897.
English abstract of DE102011003024.
English abstract of DE102011117244.

* cited by examiner

ADJUSTABLE CAMSHAFT

CROSS REFERENCE TO RELATED APPLICATIONS

This application is a U.S. National Stage Entry of International Patent Application Serial Number PCT/EP2014/003008, filed Nov. 11, 2014, which claims priority to German Patent Application No. DE 10 2013 112 539.5 filed Nov. 14, 2013, the entire contents of both of which are incorporated herein by reference.

FIELD

The present disclosure relates to adjustable camshafts that can be used in internal combustion engines.

BACKGROUND

Adjustable camshafts for internal combustion engines having a support shaft which extends in a rotational axis are known, and at least one cam pack is received on the support shaft such that it can be moved in the direction of the rotational axis. The cam pack corotates with the rotation of the support shaft, for which purpose a spline structure between the support shaft and the cam pack can serve, and a rotation of the cam pack on the support shaft is prevented by way of the spline structure. In order to latch the cam pack in discrete axial positions on the support shaft in reproducible axial positions, latching elements are known which can be prestressed by way of spring elements, and the latching elements can latch into latching element receptacles, as a result of which the axial position of the cam pack on the support shaft is defined. The different axial positions of the cam pack on the support shaft serve to bring different cam elements which the cam pack can have into connection with valves or tapping elements for actuating valves. The different cam elements can define different control times for opening and closing the valves of the internal combustion engine, or the valve stroke can be changed by way of different cam elements in operative connection with a tapping element or directly with a valve. Here, the change takes place by way of different, discrete axial positions of the cam pack being assumed on the support shaft, and the displacement of the cam pack takes place, for example, by way of a manipulation means which is received in a stationary manner in the cylinder head and can interact with an adjusting element which can likewise be included by the cam pack.

For example, DE 10 2010 011 897 A1 discloses an adjustable camshaft for an internal combustion engine having a support shaft which extends in a rotational axis, and a cam pack is received on the support shaft such that it can be moved axially. A latching element in the form of a ball which is loaded by way of a spring force of a spring element serves to latch the cam pack in discrete axial positions. The ball can latch into different profile grooves as a result of the spring force, and the profile grooves are arranged with regard to the axial position in such a way that each profile groove corresponds to the contact of an associated cam track of a cam element against a tapping element.

The latching element and the spring element for loading the latching element with force are arranged in a receiving bore of the camshaft, the latching element receptacles being made on the inner side in the cam pack in the form of the profile grooves. If the camshaft has to be assembled, first of all the spring element has to be inserted into the receiving bore in the camshaft, and subsequently the latching element has to be inserted into the receiving bore counter to the spring force before the cam pack is arranged on the support shaft. When the cam pack is subsequently pushed on, the difficulty arises that the latching element has to be pressed into the receiving bore counter to the spring force of the spring element, in order to prevent blocking of the cam pack when being pushed onto the support shaft by way of the spherical latching element.

Furthermore, the disadvantage arises that, when the spring element or the latching element is not installed in a positionally correct manner during mounting of the cam pack on the support shaft or when the latching element or the spring element are mislaid, this error is discovered only during final control of the camshaft. Here, a rectification is disadvantageously not possible without complete dismantling of the camshaft.

It is additionally to be ensured during the production of the bores in the support shaft that there is a sufficient clearance from the adjacent spline structure, in order that no distortion of the receiving bore for receiving the spring element and the latching element occurs during possible subsequent hardening of the support shaft or surface finishing. As a result, the lack of freedom of movement of the latching element and the spring element would impair the latching action.

DETAILED DESCRIPTION

Figure 2:
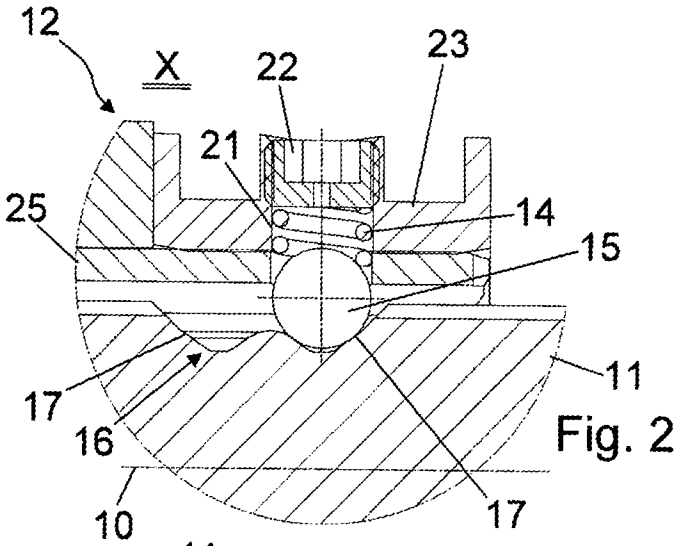
FIG. 2 is an enlarged view of detail X of the example camshaft of FIG. 1.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

The present disclosure generally concerns adjustable camshafts for internal combustion engines. In some examples, an adjustable camshaft may include a support shaft that extends in a direction of a rotational axis; at least one cam pack having at least one cam element that is received on the support shaft such that the cam pack can be displaced in the direction of the rotational axis, wherein the cam pack can be latched on the support shaft in at least two axial latching positions; and at least one latching element that is prestressed by way of a spring element and at least one latching element receptacle being provided in order to form the latching positions, wherein the latching element can latch into the latching element receptacle in the latching positions.

Further, in some examples, an adjustable camshaft for an internal combustion engine may include a support shaft and a cam pack which is received on the support shaft such that it can be displaced axially; means for latching the cam pack in discrete axial positions on the support shaft are to be formed which are of simple configuration, make easy mounting of the cam pack on the support shaft possible and, in particular, are adjustable. A spring element and a latching element which is prestressed by way of it may be received in the cam pack. At least one latching element receptacle may be arranged on the support shaft.

As a result of the arrangement according to the invention of the latching means having at least one latching element and at least one spring element for prestressing the latching element in the cam pack, the disadvantages which are described in the above text are overcome in an advantageous way. In particular, the cam pack can be pushed on without the previous arrangement of the latching element and the spring element on the support shaft, and blocking of the cam pack by way of the, in particular, spherical latching element does not arise. Furthermore, the advantage arises that the latching element and the spring element can be arranged on the cam pack only after arrangement of the cam pack on the support shaft, and that the prestress of the latching element by way of the spring element can be applied only subsequently. As a result, particularly satisfactory checking of the prestress as intended of the latching element by way of the spring element and the latching of the cam pack in the discrete latching positions on the support shaft is possible, and any possibly required rectification of the elements can be performed without renewed dismantling of the camshaft, in particular without removal of the cam pack from the support shaft.

It is further advantageous that the arrangement of a receiving bore in the support shaft can be dispensed with as a result of the arrangement of the latching element and the spring element in the cam pack. A positively locking geometry can be provided between the support shaft and the cam pack, which positively locking geometry comprises, for example, a groove structure or spline structure on the inner side of the cam pack and on the outer side of the support shaft, the structures engaging into one another in such a way that the cam pack can slide on the support shaft in a rotationally fixed and axially movable manner. The positively locking geometry can preferably be configured as a spline structure and can be supplied to a subsequent hardening process. Here, the disadvantage does not arise that the receiving bore for receiving the spring element and the latching element experiences a distortion as a result, for example, of an introduction of heat. Furthermore, a sufficient clearance of the adjacent spline structure from the receiving bore does not have to be ensured.

According to one advantageously developed embodiment for forming the latching element receptacle, a circumferential groove can be made for each of the latching element receptacles in the support shaft, into which groove latching elements which are arranged on the cam pack can latch as a result of the spring force of the spring element. If, for example, two latching positions have to be provided for the cam pack, two adjacent circumferential grooves can be made in the support shaft. In the case of three axial latching positions of the cam pack on the support shaft, for example if three cam elements with different contours or winding position are arranged on the cam pack, three circumferential grooves can be made in the support shaft in a manner which corresponds to this, etc.

According to one alternative refinement, the latching element receptacle can be configured as a groove which is limited to one circumferential region or as a depression in the outer circumference of the support shaft. The depression can be, for example, of funnel-shaped configuration, in particular in the form of a countersunk bore. The groove which is limited to one circumferential region can have, for example, a tangential course and can be produced by way of a milling operation. In contrast, the circumferential groove can be made in the support shaft by way of a turning operation.

According to a further embodiment, the latching element receptacle can be formed by an insert element, it being possible for a receiving groove to be made in the outer circumference of the support shaft for receiving the insert element. Here, the insert element can be inserted into the receiving groove. In particular, in the case of a support shaft of hollow configuration with a relatively small wall thickness, receiving grooves for receiving insert elements are suitable if it is not technically possible or is not appropriately possible to introduce a circumferential groove or a groove which is limited to one circumferential region as a result of the small wall thickness.

In the case of a plurality of grooves, the latching element receptacle can have an undulating shape, the direction points toward the latching element, and the latching element can slide along over the undulating shape during a movement of the cam pack in the direction of the rotational axis. Here, in particular, the wave troughs of the undulating shape correspond to the number of latching element receptacles and therefore to the number of grooves.

According to a further feature of the present refinement according to the invention of the cam pack, said cam pack has at least one receiving bore, in which the spring element and the latching element which is prestressed by way of it are received. The receiving bore can be configured, for example, as a threaded bore, it being possible for a screw element to be provided which is screwed into the threaded bore. As a result, the advantage is achieved that the spring element can be braced between the latching element and the screw element, with the result that the spring prestress against the latching element can be set by way of a change in the screw-in depth of the screw element in the receiving bore. The receiving bore preferably extends in a bore axis which runs perpendicularly with respect to the rotational axis of the support shaft, the latter forming the axial displacement direction of the cam pack. The receiving bore therefore also extends perpendicularly with respect to the displacement direction of the cam pack.

Finally, in particular in addition to the at least one cam element, the cam pack can comprise an adjusting element, it being possible for the receiving bore for receiving the latching element and the spring element to be made at least partially in the adjusting element. In the context of the present invention, there is also the option of providing a plurality of receiving bores in the cam pack, and an associated latching element and a spring element are situated in each of the receiving bores. Therefore, latching element receptacles which are spaced apart from one another can also be provided, for example, in the support shaft, which latching element receptacles therefore do not have to be arranged adjacently next to one another.

Furthermore, the object of the present invention is achieved by way of a method for assembling a camshaft for an internal combustion engine having a support shaft which extends in a rotational axis, at least one cam pack having at least one cam element being arranged on the support shaft such that it can be displaced in the direction of the rotational axis, at least one latching element which is prestressed by means of a spring element being provided in the direction of the rotational axis on the support shaft in order to form at least two latching positions of the cam pack, and the method first of all providing provision of a support shaft with at least one latching element receptacle which is arranged on it, subsequently the step of pushing of the cam pack onto the support shaft being provided, and subsequently the latching element and the spring element being arranged on the cam pack.

According to one development of the method, the latching element and the spring element can be introduced into a receiving bore which is made in the cam pack, a screw element being provided, furthermore, which is screwed into the receiving bore in accordance with a further step of the method. Subsequently, the step of setting of the spring prestress of the spring element against the latching element by way of changing the screw-in depth of the screw element in the receiving bore can follow.

Figure 1:
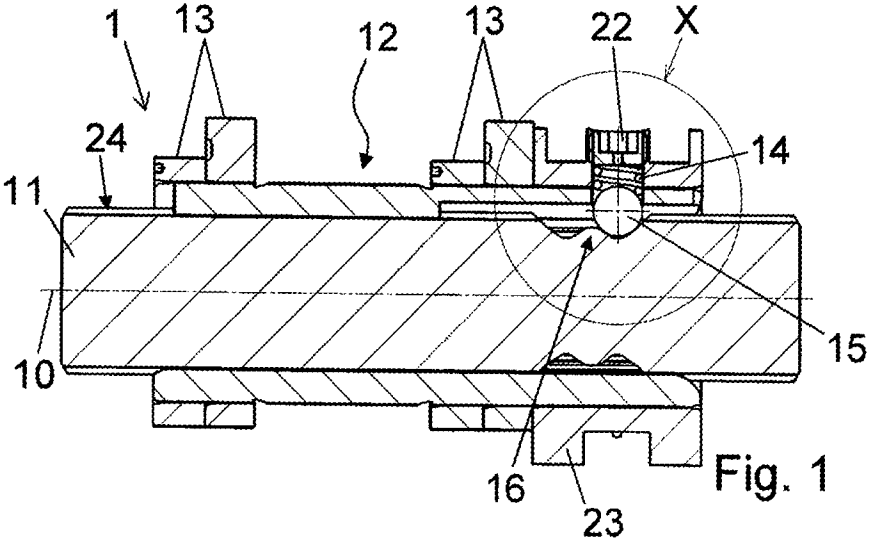
FIG. 1 is a cross-sectional view of an example camshaft having an example cam pack disposed on and axially movably along an example support shaft.

FIG. 1 shows one exemplary embodiment of a camshaft 1 having the features of the present invention in a cross-sectional view. The camshaft 1 is intended for an internal combustion engine and can be received, for example, in the cylinder head of the internal combustion engine such that it can be rotated about a rotational axis 10. The camshaft 1 has a support shaft 11 which is configured as a solid rod. A cam pack 12 is received on the support shaft 11, and the cam pack 12 has a passage, through which the support shaft 11 extends. The cam pack 12 is longitudinally movable in the direction of the rotational axis 10 and can be displaced to and fro in both directions of the rotational axis 10 in accordance with the double arrow which is shown. In order to introduce the displacement movement into the cam pack 12, the cam pack 12 has an adjusting element 23, into which an external manipulation means (not shown) can engage and which displaces the cam pack 12 axially.

The cam pack 12 has, for example, two cam elements 13 with different cam contours which are different from one another, and the different cam elements 13 can be brought into connection with a tapping element for valve actuation in a manner which is dependent on the axial position of the cam pack 12 on the support shaft 11. In order to fix the cam pack 12 in two discrete axial positions on the support shaft 11, latching means are provided which will be described in greater detail in the following text.

By way of example, a latching element 15 in the form of a ball is shown for forming the axial latching positions of the cam pack 12 on the support shaft 11, and the latching element 15 can latch in a latching element receptacle 16. A spring element 14 which prestresses the latching element 15 into the latching element receptacle 16 is provided for latching the latching element 15 in the latching element receptacle 16.

In a manner which corresponds to the number of cam elements 13, the latching element receptacle 16 has two circumferential grooves 17 which are spaced apart axially and are made in the support shaft 11. Here, the latching element 15 and the spring element 14 are situated such that they are arranged in the cam pack 12.

The illustration shows the cam pack 12 in a latching position which is determined by the right-hand circumferential groove 17, see FIG. 2 in this regard. If the cam pack 12 is displaced to the left by way of the external manipulation means in engagement with an adjusting element 23, the latching element 15 can be guided out of the right-hand circumferential groove 17 counter to the force of the spring element 14 until the latching element 15 snaps into the left-hand circumferential groove 17. As a result, two axial positions can be assumed by way of the cam pack 12 which is shown.

In order to fix the spring element 14 and the latching element 15 in a receiving bore 21 provided for receiving in the cam pack 12, a screw element 22 is shown, and the screw element 22 serves to set the spring prestress of the spring element 14 against the latching element 15, as described in greater detail in conjunction with FIG. 2.

FIG. 2 shows an enlarged view of the detail X according to FIG. 1. The detail shows a part of the support shaft 11 which is of solid configuration and extends along the rotational axis 10. The two circumferential grooves 17 for forming the latching element receptacles 16 are shown in greater detail in the outer circumference of the support shaft 11, and the illustration shows the latching of the latching element 15 in one of the latching element receptacles 16, formed by way of the circumferential groove 17 which is formed on the right-hand side in the support shaft 11.

A receiving bore 21 is made in the cam pack 12 in order to receive the spring element 14 and the latching element 15 in the cam pack 12. The receiving bore 21 runs perpendicularly with respect to the rotational axis 10 of the support shaft 11 and guides the spherical latching element 15, with the result that the latching element 15 can perform a stroke movement in the receiving bore 21 counter to the spring force of the spring element 14. As a result of the axial displacement of the cam pack 12, the latching element 15 can therefore optionally latch in the right-hand (as shown) circumferential groove 17 or in the left-hand circumferential groove 17 of the latching element receptacle 16.

The receiving bore 21 is configured at least in sections as a threaded bore, with the result that the screw element 22 can finally be screwed into the receiving bore 21. The prestressing force of the spring element 14 can be changed by way of the screw-in depth of the screw element 22 into the receiving bore 21, with the result that the latching means can be adjusted with a variable latching force. The receiving bore 21 is made in sections in the adjusting element 23, the cam pack 12 comprising a main body 25, through which the receiving bore 21 extends further.

Figure 3:
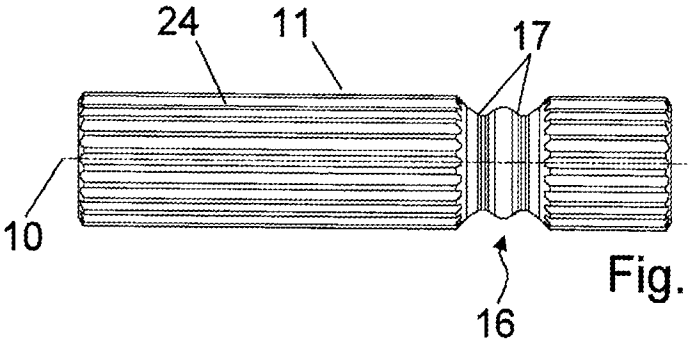
FIG. 3 is a side view of an example support shaft having example latching element receptacles configured as circumferential grooves.

FIG. 3 shows a side view of the support shaft 11 which extends along the rotational axis 10, and a spline structure 24 is shown on the outer circumference of the support shaft 11, in order to prevent rotation of the cam pack 12 on the support shaft 11. Here, a corresponding inner-side spline structure is situated in the passage of the cam pack 12, with the result that the spline structure 24 can engage in a positively locking manner into the spline structure in the cam pack 12. The latching element receptacles 16 are shown on the outer circumference of the support shaft 11 in the form of two circumferential grooves 17 which are arranged adjacently with respect to one another. This results in an undulating contour through the latching element receptacle 16, along which the latching element 15 can run while performing a stroke movement in the receiving bore 21.

Figure 4A:
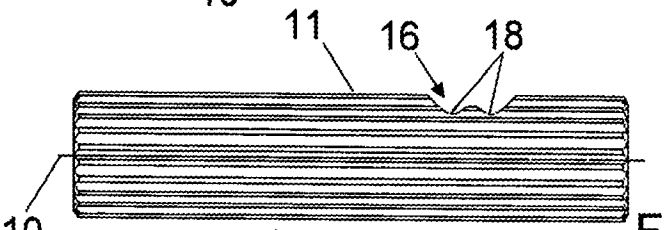
FIG. 4*a* is a side view of an example support shaft having an example latching element receptacle configured as a locally limited groove.
Figure 4B:
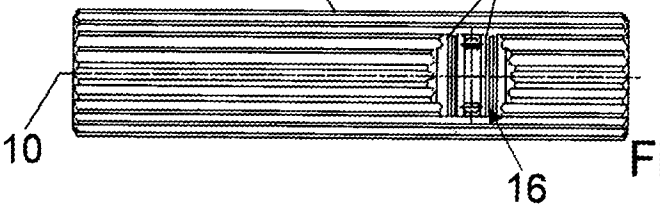
FIG. 4*b* is a plan view of the example support shaft of FIG. 4*a*.

FIGS. 4*a* and 4*b* show a further exemplary embodiment of a support shaft 11 which extends along a rotational axis 10, and the latching element receptacle 16 is made in the support shaft 11 in the form of two grooves 18 which are not of circumferential configuration, but are rather merely limited to one circumferential region of the support shaft 11. Here, FIG. 4*a* shows the support shaft 11 in a rotational position which shows the grooves 18 from the side, with the result that the undulating structure as a result of the grooves 18 can be seen, and FIG. 4*b* shows the support shaft 11 in a rotational position which shows the grooves 18 in a plan view. According to said exemplary embodiment, it is necessary to adapt the position of the latching element 15 in the cam pack 12 to the circumferential position of the groove 18 in the support shaft 11; the advantage here is that the support shaft 11 is weakened to a lesser extent as a result of the grooves 18 which are configured in a merely locally limited manner.

Figure 5:
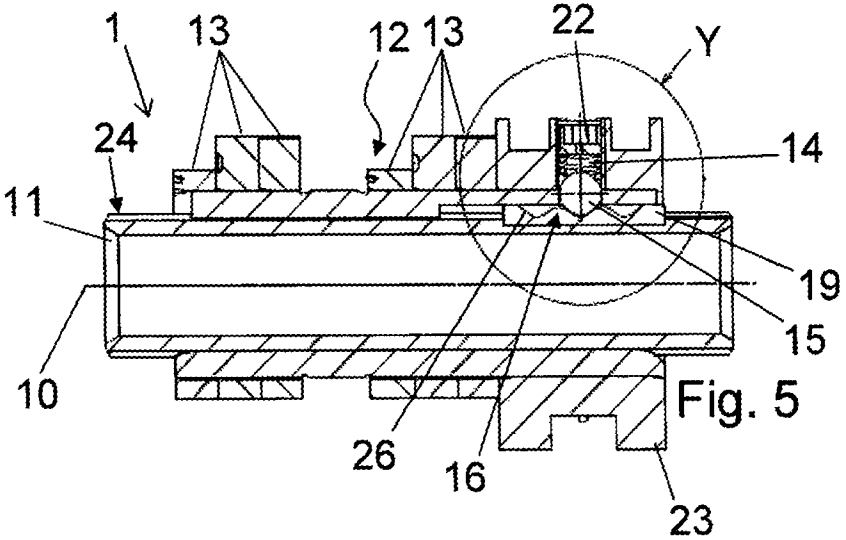
FIG. 5 is a cross-sectional view of an example camshaft having an example support shaft with a hollow configuration on which an axially displaceable cam pack is disposed.

FIG. 5 shows a further exemplary embodiment of a camshaft 1 with a support shaft 11 which extends along a rotational axis 10, the support shaft 11 being of hollow configuration and therefore being formed by a tube. A spline structure 24 is situated on the outer side of the support shaft 11 for engagement into a spline structure which is made on the inner side in the cam pack 12. The cam pack 12 has cam elements 13 and an adjusting element 23, the exemplary embodiment of the cam pack 12 having three cam elements 13 which are arranged axially next to one another. In a manner which corresponds to the number of cam elements 13, the latching element receptacle 16 on the support shaft 11 has three latching notches 26, as will be described in greater detail in the following text in conjunction with FIG. 6.

The latching means according to said exemplary embodiment of the camshaft 1 comprise an insert element 19, in which the latching element receptacle 16 is made by way of three depressions. The insert element 19 lies in a receiving groove 20 which is made on the outer circumference of the support shaft 11 of tubular configuration. As a result, the advantage arises that deeper grooves do not have to be made in the support shaft 11 with a small wall thickness, as described in conjunction with FIG. 1.

The receiving bore 21 for receiving the spherical latching element 15, the spring element 14 and the screw element 22 is configured in the adjusting element 23 of the cam pack 12, and the prestressing force of the spring element 14 against the latching element 15 can be changed via the screw element 22, as has already been described in conjunction with FIG. 1.

Figure 6:
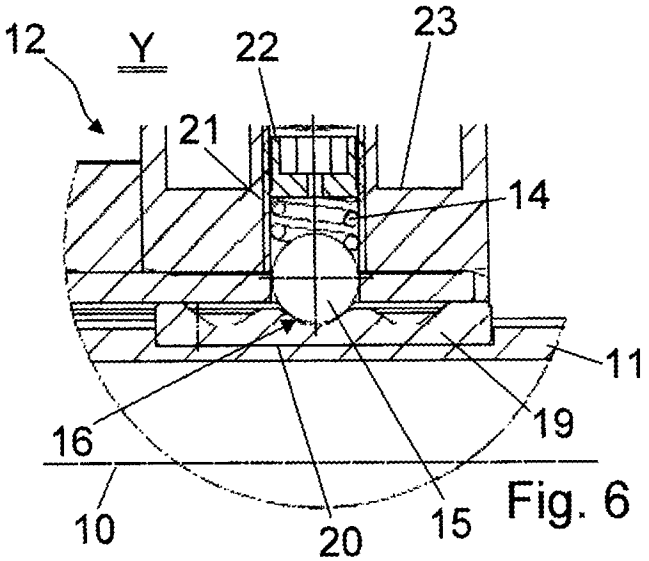
FIG. 6 is an enlarged view of detail Y of the example camshaft of FIG. 5.
Figure 7A:
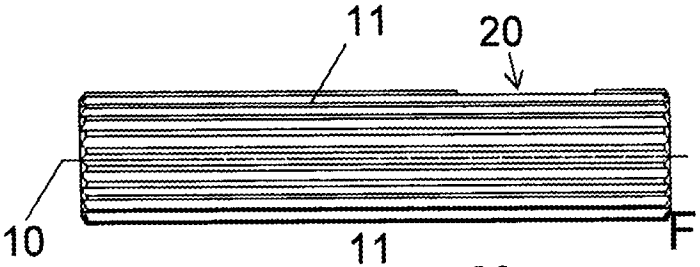
FIG. 7*a* is a side view of an example support shaft having an example receiving groove.
Figure 7B:
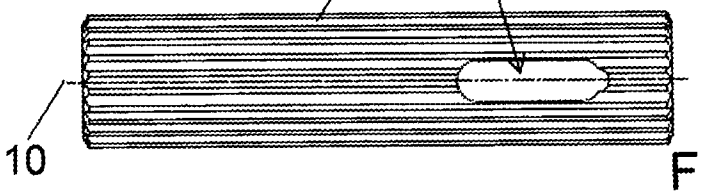
FIG. 7*b* is a plan view of the example support shaft of FIG. 7*a*.

FIGS. 7*a* and 7*b* show the support shaft 11 according to the exemplary embodiment in FIGS. 5 and 6, and FIG. 7*a* shows the support shaft 11 in a rotational position about the rotational axis 10, in which rotational position the receiving groove 20 is shown from the side, and FIG. 7*b* shows the support shaft 11 in a rotational position about the rotational axis 10, in which rotational position the receiving groove 20 is shown in a plan view.

In terms of its embodiment, the invention is not restricted to the preferred exemplary embodiment which is specified in the above text. Rather, a number of variants are conceivable which make use of the solution which is shown, even in embodiments of fundamentally different type. All features and/or advantages which are apparent from the claims, the description or the drawings, including structural details or spatial arrangements, can be essential to the invention both per se and in a very wide variety of combinations.

What is claimed is:

1. An adjustable camshaft for an internal combustion engine, the adjustable camshaft comprising:

a support shaft extending along a rotational axis;

a cam pack including a cam element disposed on the support shaft such that the cam pack is displaceable along the support shaft along the rotational axis, wherein the cam pack is latchable on the support shaft in at least two axial latching positions;

a latching element that is prestressed by a spring element, wherein the latching element and the spring element are received in a receiving bore of the cam pack;

a latching element receptacle on the support shaft for receiving the latching element in the at least two axial latching positions; and a screw element that is received in threads of the receiving bore, wherein the spring element is disposed between the latching element and the screw element, wherein an amount of prestress that the spring element exerts on the latching element depends on a screw-in depth of the screw element in the receiving bore.

2. The adjustable camshaft of claim 1 wherein the latching element receptacle comprises a circumferential groove in an outer circumference of the support shaft.

3. The adjustable camshaft of claim 1 wherein the latching element receptacle comprises a groove that is limited to a single circumferential region of the support shaft or wherein the latching element receptacle comprises a depression in an outer circumference of the support shaft.

4. The adjustable camshaft of claim 1 wherein the latching element receptacle comprises an insert element, wherein an outer circumference of the support shaft comprises a receiving groove, wherein the insert element is disposed in the receiving groove of the support shaft.

5. The adjustable camshaft of claim 1 wherein the latching element receptacle has an undulating shape that points in a direction of the latching element, wherein the latching element is slidable over the undulating shape of the latching element receptacle during movement of the cam pack along the rotational axis.

6. The adjustable camshaft of claim 1 wherein the cam pack comprises an adjusting element, wherein the receiving bore is at least partially formed in the adjusting element of the cam pack.

7. A method for assembling an adjustable camshaft for an internal combustion engine having a support shaft that extends in a direction of a rotational axis, at least one cam pack having at least one cam element arranged on the support shaft such that the cam pack is displaceable in the direction of the rotational axis, at least one latching element that is prestressed by a spring element being provided in the direction of the rotational axis on the support shaft to form at least two latching positions of the cam pack, the method comprising:

providing a support shaft with at least one latching element receptacle disposed on the support shaft;

pushing the cam pack onto the support shaft;

arranging the latching element and the spring element on the cam pack;

introducing the latching element and the spring element into a receiving bore of the cam pack;

screwing a screw element into the receiving bore; and setting a spring prestress of the spring element against the latching element by changing a screw-in depth of the screw element in the receiving bore.

* * * * *